United States Patent [19]

Bione et al.

[11] Patent Number: 4,475,430

[45] Date of Patent: Oct. 9, 1984

[54] DIFFERENTIAL SAMPLING CIRCUIT FOR IMPROVING SIGNAL TO NOISE RATIO IN AN ELECTRONIC ORGAN HAVING MULTIPLEXED KEYING

[75] Inventors: Angelo A. Bione, Elmhurst; Brian M. Bagus, Bartlett, both of Ill.

[73] Assignee: The Marmon Group, Inc., Chicago, Ill.

[21] Appl. No.: 505,313

[22] Filed: Jun. 17, 1983

[51] Int. Cl.[3] ..... G10H 1/08

[52] U.S. Cl. ..... 84/1.22; 84/1.23

[58] Field of Search ..... 84/1.22, 1.23, 1.24

[56] References Cited

U.S. PATENT DOCUMENTS

| | | | |
|---|---|---|---|
| 3,534,144 | 10/1970 | Ring | 84/1.23 X |
| 3,626,076 | 12/1971 | Uchiyama | 84/1.23 |
| 3,636,231 | 1/1972 | Schrecongost et al. | 84/1.23 |
| 3,748,944 | 7/1973 | Schrecongost | 84/1.22 |
| 3,755,609 | 8/1973 | Millet et al. | 84/1.23 |
| 4,134,321 | 1/1979 | Woron | 84/1.22 |
| 4,141,270 | 2/1979 | Schrecongost | 84/1.24 |
| 4,227,432 | 10/1980 | Bagus | 84/1.23 X |

*Primary Examiner*—Stanley J. Witkowski

*Attorney, Agent, or Firm*—Neuman, Williams, Anderson & Olson

[57] ABSTRACT

The present invention is a differential sampling circuit for improving the signal to noise ratio by eliminating d.c. level distortion in square wave signals used as components for forming a stairstep or bright wave signal in an electronic organ having multiplexed keying. The multiplexed drawbar signals for even footages at both sides of a sampling resistor are demultiplexed, applied to a sample and hold circuit and applied as inputs to a differential amplifier to cancel any fluctuations of the d.c. signal component.

2 Claims, 2 Drawing Figures

DIFFERENTIAL SAMPLING CIRCUIT FOR IMPROVING SIGNAL TO NOISE RATIO IN AN ELECTRONIC ORGAN HAVING MULTIPLEXED KEYING

FIELD OF INVENTION

The present invention involves a differential sampling circuit for improving the signal to noise ratio in the generation of bright wave signals in an electronic organ having multiplexed keying. Many organs use square wave signals as the tone signal input to standard keyer circuits to generate musical notes. However, the square wave signal is particularly deficient in even harmonics and accordingly to enhance the musical signal various carefully scaled octavely related square waves are combined together to form a stairstep wave generally referred to as a bright wave signal.

PRIOR ART

The generation of bright wave signals in electronic organs is well known in the music industry. Such systems are disclosed in U.S. Pat. No. 3,534,144 entitled Keyer-Synthesizer for an Electronic Musical Instrument Employing an Integrated Circuit which issued on Oct. 13, 1970 and U.S. Pat. No. 3,748,944 entitled Electronic Musical Instrument Having a Multiplexed Keying which issued on Oct. 14, 1980 each of which are included herein by reference. A bright wave signal is produced by combining a plurality of carefully scaled octavely related of square wave signals to produce a stairstep waveform which is a close approximation to a sawtooth wave form. What is required to make the bright wave is a square wave having its fundamental frequency at the desired musical note frequency and at a certain voltage level. To this fundamental frequency waveform is added the square wave an octave higher at half the voltage level plus the square wave two octaves higher at one fourth the voltage level of the fundamental, plus the square wave three octaves higher at one eighth the voltage level. This process of addition can be continued by adding successively higher octave signals at appropriately reduced amplitude levels to produce an increasingly smoother sawtooth waveform. However, the addition of four octaves of square waves is sufficient for practical purposes.

In the mutliplexed organ described in U.S. Pat. No. 4,227,432 the information from the drawbars for each footage, e.g., 16′, 8′, $5\frac{1}{3}$′, 4′, $2\frac{2}{3}$ and 2′ is multiplexed in separate circuits and each signal is applied via a buffer circuit across a sampling resistor to the input of standard keyer circuits. The keyer circuit also receives multiplexed keying signals and when the combined multiplexed keying signal is present together with a square wave signal for a particular frequency and the multiplexed drawbar signal the system draws current through the sampling resistor. The current through the sampling resistor is a function of the frequency of the square wave tone signal. Thus an audio signals of approximately 50 millivolts is riding upon a pulsed d.c. signal of approximately negative 14 volts. In order to provide the component signals for a bright wave the signal at one end of the resistor is demultiplexed and stored upon a sample and hold capacitor for the time period extending between sampling of the particular channel. Subsequently the square wave audio signal of about 50 millivolts is combined with other carefully scaled octavely related signals to form a bright wave signal.

Due to the large d.c. signal component in comparison to the audio signal component, slight fluctuations in the d.c. signal produce audible noise in the audio waveform. Furthermore, in the multiplexed system, if the particular channel is not continuously sampled, as taught in the co-pending application Ser. No. 505,312 entitled Dynamic Controller for Sampling Channels in an Electronic Organ Having Multiplexed Keying and filed contemporaneously herewith by the same inventors and assigned to the same assignee and incorporated herein by reference, the sample and hold capacitor drifts or decays and upon receiving a signal from the demultiplexer then quickly charges and produces a pronounced audible distortion in the form of a click or popping noise.

A general object of the present invention is to provide differential sampling circuit for improving the signal to noise ratio in an electronic organ having multiplexed keying by eliminating the d.c. level shift and the attendent audible distortion.

A specific object of the present invention is to provide differential samplnig provide a differential sampling circuit for improving the signal to noise ratio in the bright wave formation circuit of an electronic organ having multiplexed keying by sampling the signal at both sides of the sampling resistor and applying both signals to a differential circuit to remove any d.c. component signal from the bright wave component signal and eliminating the d.c. distortion in the audio output.

SUMMARY OF THE INVENTION

The present invention is a differential sampling circuit for improving the signal to noise in signal, particularly for use in generating bright wave in an electronic organ having multiplexed keying. In the preferred embodiment the harmonic information from a drawbar system is time division multiplexed, buffered and for each footage applied across a sampling resistor to a standard keyer circuit. The standard keyer circuit also receives time division multiplexed keying information and a square wave tone signal. When the keyer circuit receives all three input signals the amplitude of the current drawn through the sampling resistor is a function of the multiplexed drawbar information while the frequency of the current is a function of the square wave tone signal. In order to provide an appropriate input signal to the bright wave summation circuit, the current drawn through the sampling resistors corresponding to at least some of the even footages is sensed at both ends. Each signal thus sensed is demultiplexed and is applied to the sample and hold circuit. Both demultiplexed signals are also applied to the respective positive and negative inputs of a differential amplifier. Since the signal sampled before the resistor contains only the d.c. level information from the drawbar circuit and the signal sampled after the resistor contains the audio information imposed upon the same d.c. level signal the differential circuit cancels or rejects the d.c. component signal providing only audio signal at its output. The square wave signal output is, of course, combined with other similarly generated audio signals in a well known manner to form the stairstep bright wave signal. However, fluctuations in the d.c. signal component due to any cause, including the rapid charging of the sample and hold capacitor are eliminated through the operation of the differential amplifier.

Therefore, the signal to noise ratio of the signal output of the differential amplifier circuit is greatly improved over prior systems.

BRIEF DESCRIPTION OF THE DRAWINGS

The present invention will be more clearly understood from the following detail description of the specific embodiment, read in conjunction with the accompanying drawings, wherein.

It should be understood that the drawings are not necessarily to scale and that the embodiments are illustrated by graphic symbols and diagrammatic representations. In certain instances, details which are not necessary for an understanding of the present invention or which render other details difficult to perceive may have been omitted. It should be understood, of course, that the invention is not necessarily limited to the particular embodiment illustrated.

DETAILED DESCRIPTION

Figure 1:
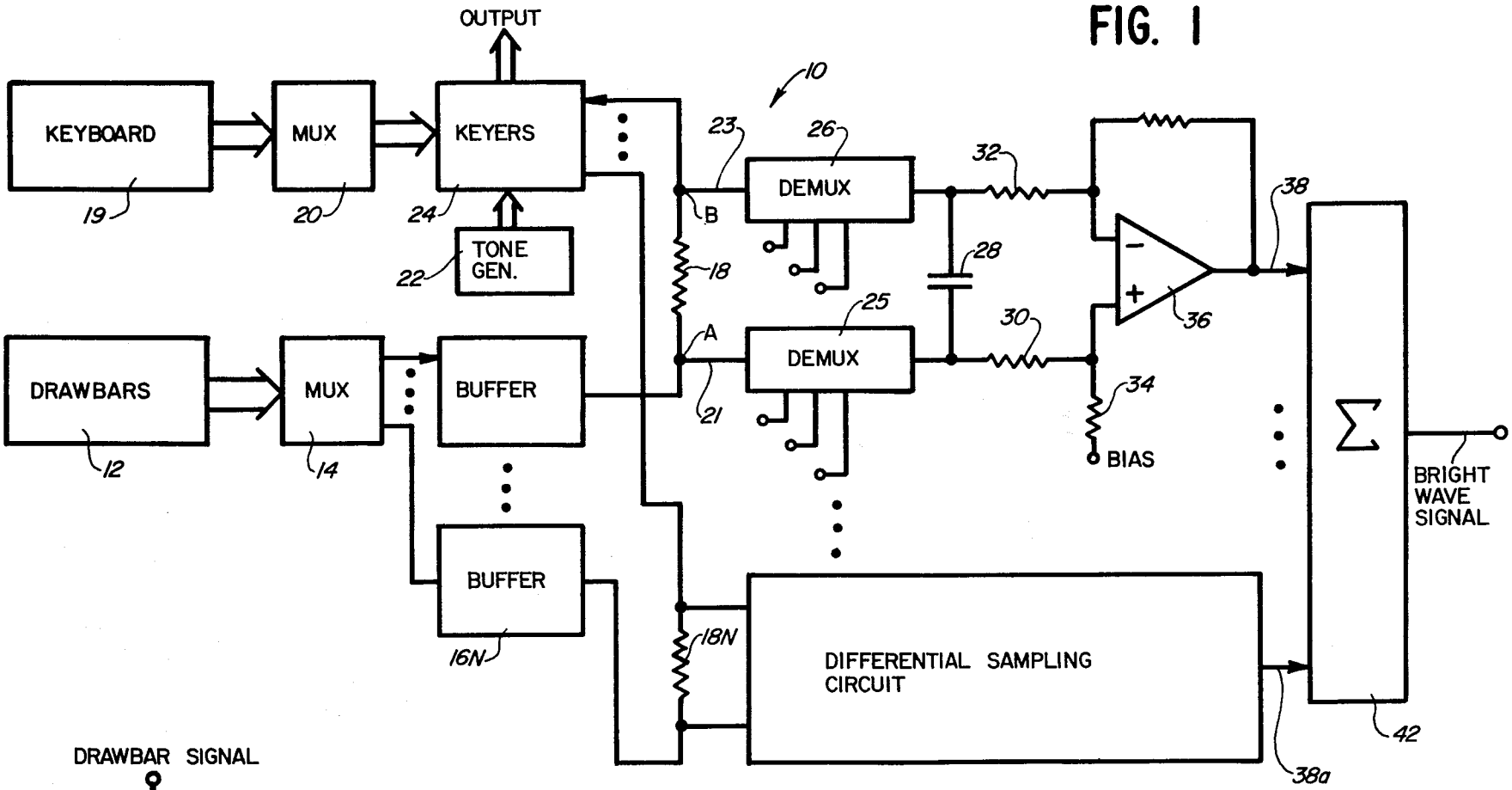
FIG. 1 is a block diagram of the differential sampling circuit of the present invention together with related standard organ circuits.

FIG. 1 shows the differential sampling circuit 10 for improving the signal to noise ratio in generating a bright wave signal component which is added with other similarly generated components in standard well known circuit of an electronic organ having multiplexed keying to produce a bright wave signal. In FIG. 1 the amplitude signals from a drawbar circuit 12 are applied to a multiplexer 14. The multiplexed drawbar amplitude signal for each footage is respectively applied to an output line of multiplexer 14. Each output line of multiplexer 14 is connected to the input of a standard buffer circuits 16 through **16*n*. The output of each buffer circuit 16 through 16*n* is applied across a respective sample resistors 18 through 18*n*, typically in the range of 100 ohms, and to a standard keyer circuit 24. Keying information from a standard 61 note keyboard 19 is applied to a multiplexer 20. The multiplexed keying information from multiplexer 20, the multiplexed drawbar information from buffers 16 through 16*n* and square wave tone signals from a standard tone signal generator 22 are applied to the keyer circuit 24 for providing output signals. The output signals from keyer circuit 24** are applied to standard organ demultiplexer filter amplifier and speaker circuits (not shown) to provide audio output.

Figure 2:
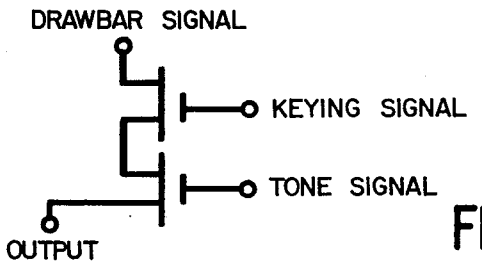
FIG. 2 is a representation of the standard keyer circuit used in electronic organs.

FIG. 2 shows one of the plurality of individual keyers comprising the keyer circuit 24. In the preferred embodiment each keyer circuit comprises two series connected FET's in which the first FET receives the drawbar signal and the keying signal while the second FET receives the output from the first FET and the square wave tone signal to provide an output. For a more detailed explanation of the operation of the individual keyer circuit of FIG. 2 reference is made to U.S. Pat. No. 3,748,944.

When a multiplexed drawbar signal and a multiplexed keying signal together with a square wave tone signal are applied to the keyer circuit of FIG. 2 current is drawn through one of the resistors 18 through **18*n***. The amplitude of this current is a function of the amplitude of the drawbar signal and the frequency is a function of the square wave tone signal.

For the 16 foot signal, the multiplexed drawbar signal is sampled at a point before resistor 18 to provide a signal on line 21 corresponding to the 16' d.c. level signal from the drawbar circuit 12. In addition, the signal at point B, after resistor 18 is sampled to provide a signal on line 23 corresponding to the 16' d.c. level signal from the drawbar circuit 12 including an audio frequency signal. The sampling of the signal at point B is more fully described in U.S. Pat. No. 4,141,270 entitled Modulated Keyer Supply Sampling Circuit which issued on Feb. 27, 1979 and is incorporated herein by reference. The signal on line 21 is applied to demultiplexer circuit 25 and the signal on line 23 is applied to demultiplexer circuit 26. Both of the demultiplexer circuits 25 and 26 receive input signals from the circuit described in the copending application Ser. No. 505,312 entitled Dynamic Controller for Sampling Channels in an Electronic Organ Having Multiplexed Keying filed concurrently herewith and referred to above to determine when sampling for bright wave signals will occur. The output signals from demultiplexers 25 and 26 are used to charge sample and hold capacitor 28. The output of demultiplexer 25 is also applied through resistor 30 to the positive input of differential amplifier 36. The output of demultiplexer 26 is also applied through resistor 32 to the negative input of differential amplifier 36. An appropriate bias signal is also applied to the differential amplifier 36, the operation of which is well known to those of ordinary skill in the art and further description is considered unnecessary.

The d.c. component signal at the positive input to differential amplifier 32 negates or cancels the d.c. component signal at the negative input to differential amplifier 32 and the output on line 38 represents only the square wave audio signal due to the current drawn through resistor 28. Due to the differential amplifier circuit 32 any fluctuation in the d.c. level is cancelled and does not appear on the component signal line 38.

The square wave signal at line 38 represents the 16' component for the stairstep bright wave signal. The other component signals such as the eight foot, four foot and two foot signals are generated in identical circuits illustrated in FIG. 1 by differential sampling circuit 40. The output lines 38 through **38*n* are connected to the summation circuit 42. The summation circuit 44 combines all the square wave signals on lines 38 through 38*n* in a manner well known in the art and further description of which is considered unnecessary to form the bright wave signal. The bright wave signal output of summation circuit 42** is, of course, applied to standard organ amplifier filter and speaker circuits (not shown) to provide an audio output.

What is claimed is:

1. A circuit for improving the signal to noise ratio in an electronic organ having summation circuit means for producing bright wave signals, harmonic multiplexer means for providing a plurality of multiplexed signals each representing a drawbar amplitude signal for a different footage, keying multiplexer means for providing a plurality of multiplexed signals each representing a keying signal, a tone generator for providing a plurality of square wave signals, each representing a different tone, a keyer circuit for receiving said plurality of multiplexed signals each representing a drawbar amplitude signal for a different footage, said plurality of multiplexed signals each representing a keying signal and said square wave signal each representing a different tone, a plurality of sampling resistors each having a first end connected to said harmonic multiplexer means for receiving one of said multiplexed signals representing a drawbar amplitude for a different footage and having a second end connected to said keyer circuit, said differential circuit having a plurality of channels and each channel comprising:

a first demultiplexer means connected to said first end of one of said plurality of sampling resistors for providing a first output signal representing a d.c. component signal;

a second demultiplexer means connected to said second end of one of said sampling resistors for providing a second output signal representing a d.c. component signal and an audio component signal;

a sample and hold circuit for receiving said first and second signal;

a differential circuit for receiving said first and second signals and for removing the d.c. component of each of said first and second signals and for providing a square wave audio output signal; and, said square wave output signal for each of said plurality of channels being connected to said summation circuit means for producing a bright wave signal.

2. A differential sampling circuit as set forth in claim 1 wherein each of said channels receives a multiplexed signal representing a drawbar amplitude signal for even footage.

* * * * *